US006254407B1

(12) United States Patent
Burns

(10) Patent No.: US 6,254,407 B1
(45) Date of Patent: Jul. 3, 2001

(54) MECHANICAL ASSIST CAM SLIDE DEVICE

(75) Inventor: Mark V. Burns, Westland, MI (US)

(73) Assignee: Framatome Connectors Interlock, Inc., Westland, MI (US)

( * ) Notice: Subject to any disclaimer, the term of this patent is extended or adjusted under 35 U.S.C. 154(b) by 0 days.

(21) Appl. No.: 09/250,795

(22) Filed: Feb. 17, 1999

(51) Int. Cl.[7] ..... H01R 13/62
(52) U.S. Cl. ..... 439/157; 439/347
(58) Field of Search ..... 439/157, 347, 439/310, 152, 153, 345, 346, 488, 489, 296, 299, 370

(56) References Cited

U.S. PATENT DOCUMENTS

| | | | | |
|---|---|---|---|---|
| 4,586,771 | | 5/1986 | Kraemer et al. | 339/75 |
| 5,236,373 | | 8/1993 | Kennedy | 439/347 |
| 5,257,944 | | 11/1993 | Kennedy | 439/347 |
| 5,575,676 | * | 11/1996 | Tsukakoshi et al. | 439/347 |
| 5,618,195 | | 4/1997 | Cappe | 439/157 |
| 5,725,398 | | 3/1998 | Cappe | 439/752 |
| 5,899,762 | * | 5/1999 | Ainceri | 439/157 |
| 5,902,141 | * | 5/1999 | Iwahori | 439/157 |
| 5,928,011 | * | 7/1999 | Flask et al. | 439/157 |
| 5,928,014 | * | 7/1999 | Sawayanagi et al. | 439/157 |
| 5,957,709 | * | 9/1999 | Heimullet et al. | 439/157 |
| 5,984,701 | * | 11/1999 | Sawayanagi et al. | 439/157 |

FOREIGN PATENT DOCUMENTS 0 625 809 A1 11/1994 (EP) .

* cited by examiner

*Primary Examiner*—Hien Vu
*Assistant Examiner*—Ross Gushi
(74) *Attorney, Agent, or Firm*—Perman & Green, LLP

(57) ABSTRACT

An electrical connector assembly is of the type having first and second connector housing parts each of the housings having a plurality of electrical terminals therein. The connector assembly further includes a caming slide for moving the housings toward and away from one another along a first path to mate and unmate the housings. The caming slide is moveable along a cam slide path extending transversely to the first path. The caming slide is slidably received within a way formed in the first housing part and has at least one caming slot formed in a surface thereof. The caming slot opens to a leading side edge of the caming slide facing the second housing part. The second housing part has at least one upstanding projection postionable initially within the at least one caming slot and driveably movable along the first path when engaged by the caming slide. A releasable detent is disposed on the first housing part and on the caming slide for releasably locking the caming slide in a first position while mounted on the first housing part corresponding to an open condition of the first housing part.

6 Claims, 4 Drawing Sheets

MECHANICAL ASSIST CAM SLIDE DEVICE

BACKGROUND OF THE INVENTION

Field of the Invention

The invention relates to a connector usable, for example in the automobile industry, and relates more particularly to an improvement in such electrical connectors whereby the wedging action between one connector part and another is better effected by the action of a laterally sliding cam slide which interengages with a blocking detent moved to a non-blocking mode when relative inward movement between the two housing parts occurs.

In assembling connectors of the type wherein a harness or the like is used to capture and connect the ends of a plurality of wires or cables to corresponding ones, it is often the situation that such connections are to be made in highly cramped and tight quarters, making the connection between connecting parts hard to manipulate.

This is in the case, such as found for example with a connection between the wire bundles in the automobile assembly process wherein connection between electrical wires must be made in cramped quarters, such as found in an under the dash board or console situation. Here, the assembly person usually has but a single hand free to cause a operative connection to be made, thus requiring that the connection between parts be made with a single hand.

Accordingly, it is an object of the present invention to provide an electrical connector which is capable of connecting first and second connector housing parts in a way which allows the user to affect the connection between the connector housing parts preferably using only single hand manipulation.

It is a further object of the invention to provide an electrical connector of the aforementioned type wherein mated components of first and second connector housing parts are otherwise in a locked condition by the action of a caming slide to effect connection.

It is still a further object of the invention to provide a typical connection of the aforementioned type wherein a resilient and structurally strong device can be provided to effect connection between corresponding connector housing parts.

SUMMARY OF THE INVENTION

The invention resides in an electrical connector assembly of the type having first and second connector housing parts which can be readily drawn together through the use of a camming slide which is otherwise locked in a normally opened condition and released for full engagement with the first part upon the insertion of the second connector housing part within the first housing part. More specifically, the electrical connector assembly is of the type having first and second connector housing parts each of the housings having a plurality of electrical terminals therein. The connector assembly further includes a caming slide for moving the housings toward and away from one another along a first path to mate and unmate the housings. The caming slide is moveable along a cam slide path extending transversely to the first path. The caming slide is slidably received within a way formed in the first housing part and has at least one caming slot formed in a surface thereof. The caming slot opens to a leading side edge of the caming slide facing the second housing part. The second housing part has at least one upstanding projection postionable initially within the at least one caming slot and driveably movable along the first path when engaged by the caming slide. A releasable detent is disposed on the first housing part and on the caming slide for releasably locking the caming slide in a first position while mounted on the first housing part corresponding to an open condition of the first housing part.

DETAILED DESCRIPTION OF THE PREFERRED EMBODIMENT

Figure 1:
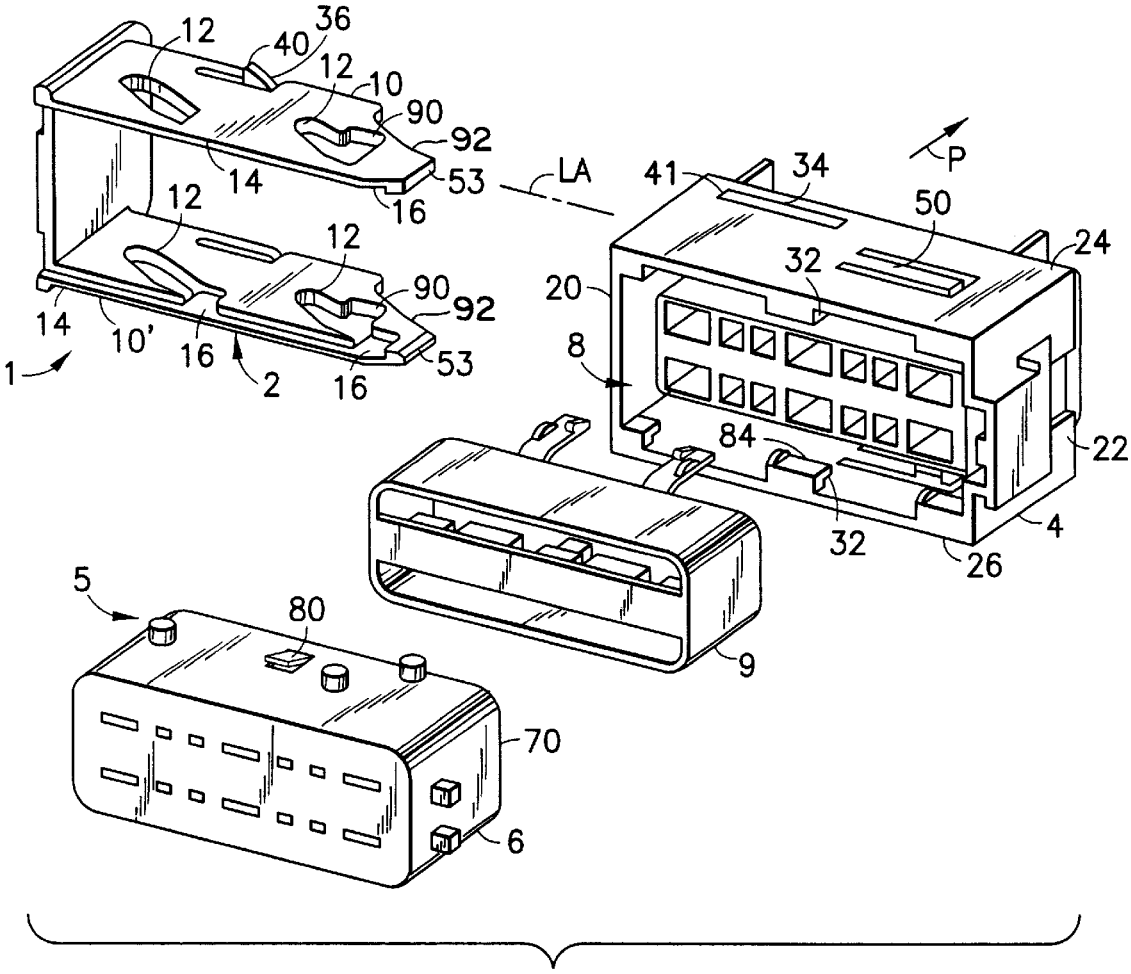
FIG. 1 is an exploded view showing the various components of a typical connector of the present invention.

FIG. 1 shows the invention in exploded view. The connector is referred generally as numeral 1 and comprises a cam slide 2 slidingly received within a first connector part 4, and a second connector part 6 which is corresponding sized and shaped to be received within the front face 8 of the first connector part 4. A wedge 9 may or may not be used in the combination, but for purposes of completeness is shown in FIG. 1. Also, the material from which the connector parts can be made can vary, but the parts are preferably made from hard plastic or other like insulating material.

As seen in FIG. 1, the cam slide 2 is provided with a generally U-shaped construction having two generally planar siding members 10,10' on which are disposed cam slots 12,12 which are directed obliquely from the longitudinal axes LA of the slide. The oblique angularization of the slide slots 12,12 taken in conjunction when engaged with a plurality of corresponding projections 5 on the second connector housing part 6 received therein, drive the second connector housing 6 inwardly toward the first connector housing part 4 along path P when the caming slide 2 is pushed laterally inwardly along the axis LA in a manner that is known in the industry.

The cam slide 2 further includes side edges 14,14 having interruptions or openings 16,16 communicating with each caming slot 12 for the purpose of introducing certain of the plurality of projections 5 of the second connector part 6 therewithin.

Figure 3A:
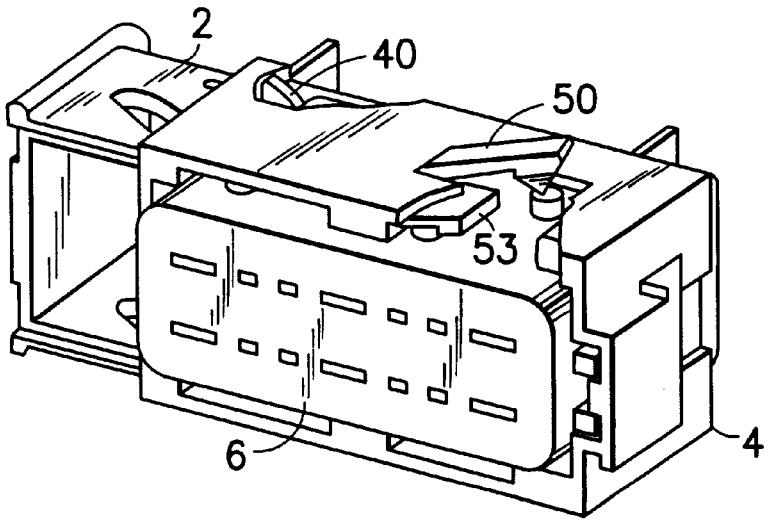
FIG. 3*a* is a partially fragmentary view of the first connector and the second connector part mated together.
Figure 3B:
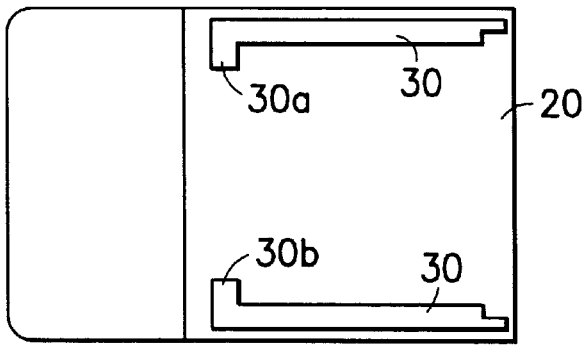
FIG. 3*b* is side view of the first connector part.

As illustrated, the first housing part 4 has two opposed sidewalls 20 and 22 and two opposed upper and lower walls 24 and 26 integrally connected with one another giving the first housing part a generally rectangular closed shape. As seen in FIG. 3B, the sidewall 20 has a pair of generally L-shaped slots 30,30 which are sized to receive corresponding ones of the generally planar sliding members 10, 10'. Also, each of the upper and lower walls 24 and 26 of the first housing part has a longitudinally extending way 32, 32 which extends parallel to the longitudinal axis LA of the connector housing. Each of the longitudinally extending ways 32,32 in the first connector housing part 4 is also located lengthwise coincidentally with a respective one of the L-shaped slots 30, 30 so as to allow an associated one of the planar sliding members 12,12 to pass through the corresponding portion of the slot 30 and be received within one of the ways 32,32.

Each of the upper and lower walls 24 and 26 of the first housing part 4 also has a longitudinally extending slot 34, 34 which extends parallel to the longitudinal axis LA of the connector. Each of the longitudinally extending slots 34,34 in the first connector housing part 4 is sized to receive an associated vertically deflectable detent 36,36 integrally formed as part of the cam slide 2. Thus, when the cam slide 2 is pushed through the L-shape openings 32,32 in the sidewall 20, it is prevented from pull-out by virtue of a stop face 40 formed on the rear face of each of the detents 36,36 abutting against the opposed vertical end surface 41 of the slots 34,34. As seen in FIG. 3*b*, the generally vertically directed portions 30*a*, 30*b* of the L-shaped openings 30,30 in the sidewall 20 permit inward deflection of the first detent members 36,36 as each is passed through the L-shaped slots 32,32.

Figure 2:
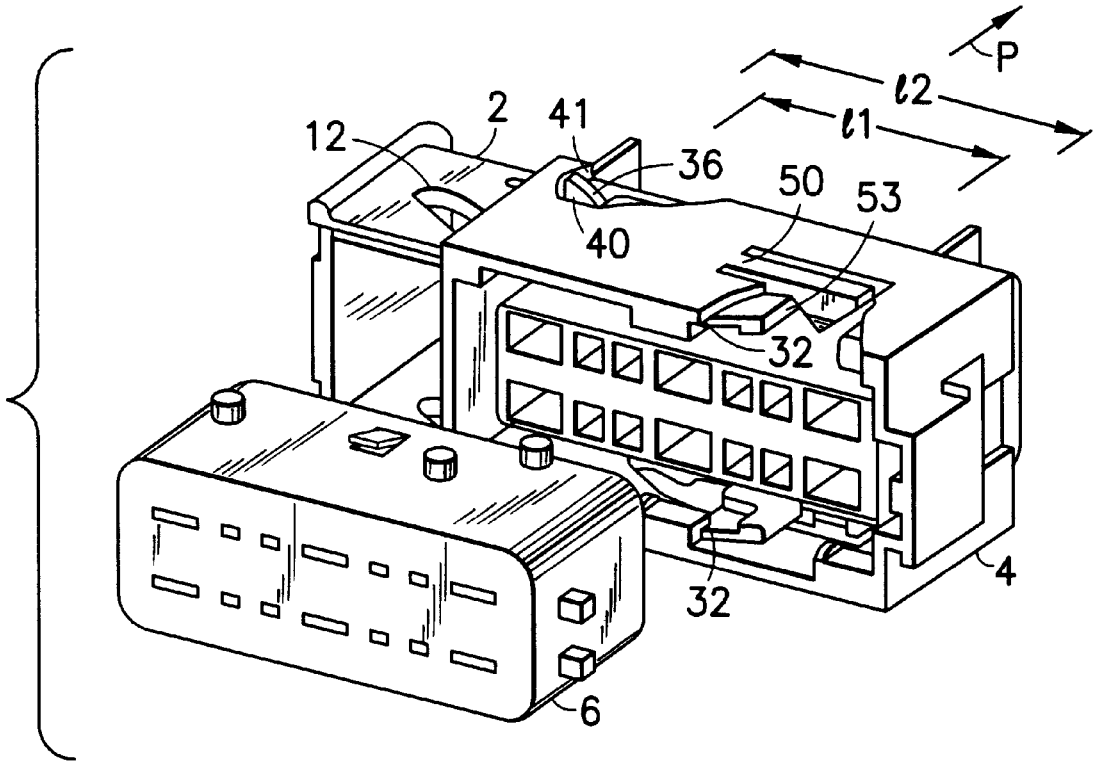
FIG. 2 is a partially fragmentary perspective view showing the first housing part in broken away view to reveal the detent finger.
Figure 3C:
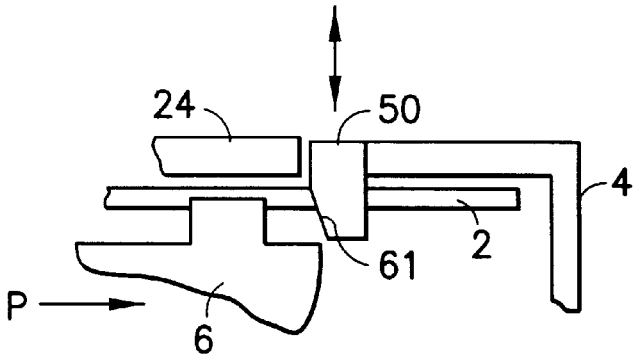
FIG. 3*c* is a partially fragmentary vertical section view of the first connector and the second connector part mating together.
Figure 3D:
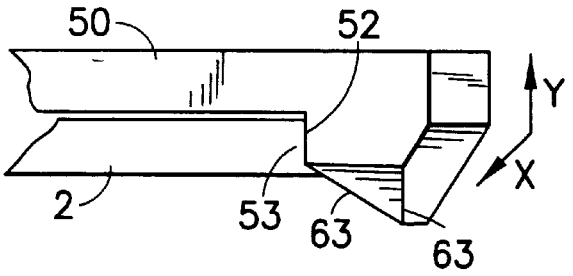
FIG. 3*d* is a detailed partially fragmentary view of the detent finger showed in broken away view in FIG. 2.
Figure 4:
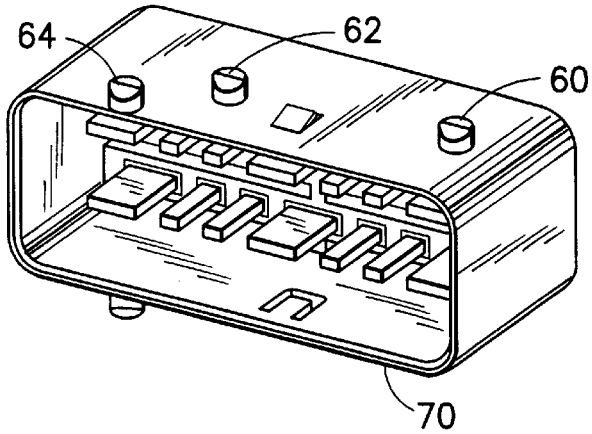
FIG. 4 is a perspective view of the second connector housing part.
Figure 5:
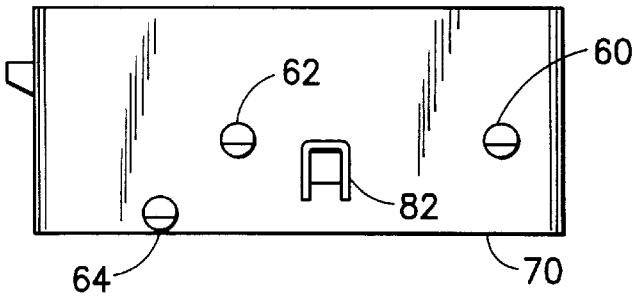
FIG. 5 is a top plan view showing the second connector housing part.
Figure 6:
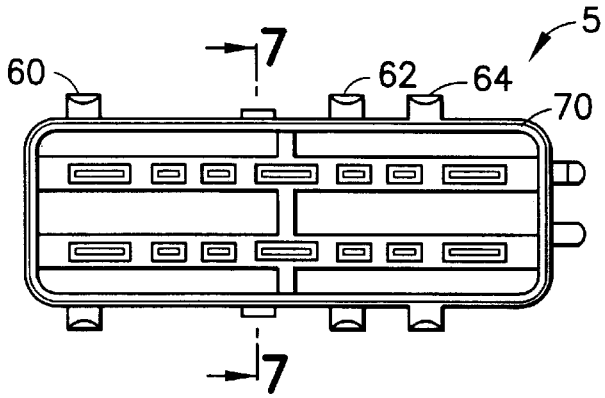
FIG. 6 is a front elevation view of the second connector housing part of FIG. 5.
Figure 7:
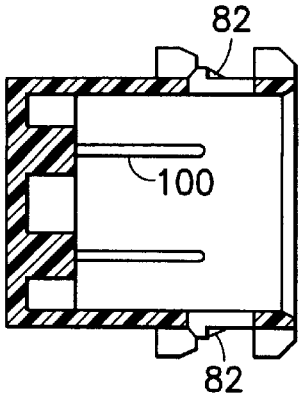
FIG. 7 is a vertical section taken through the housing part shown in FIG. 6.

As illustrated in FIGS. 2, 3*a*, 3*c* and 3*d*, the first connector part 4 also includes a second vertically deflectable detent arm 50,50 each correspondingly formed in the upper and lower walls 24 and 26, respectively, of the first connector part 4. As illustrated in FIG. 3*d*, the depending end of the first housing detent 50,50 has a vertically extending abutment face 52 which acts against a correspondingly disposed leading edge face 53 on the cam slide 2, thereby blocking its further insertion into the first housing part 4.

It should be seen that the length 11 of the cam slide 2 as taken between the abutment face 40 on the cam slide detent 36 and the leading edge 53 is somewhat smaller in dimension than the length 12 between the stop face 52 of the first housing detent arm 50 and the end face 41 of the slot 32. Thus, as illustrated in FIG. 2, the cam slide becomes captured between the stop face 41 in the slot 52 of the first housing part 4 thus preventing pull out of the cam slide therefrom, and is further prevented from being pushed inwardly past the stop face 52 of the first housing detent member 52. The tolerance between the 11 and 12 dimensions is quite small thereby making play in the longitudinal direction of the axis LA quite negligible between the involved parts.

As illustrated in FIG. 3*c*, the depending portion of the detent 50 has a generally pyramidal shape. This shape is provided by a forwardly facing caming surface 61 (see FIG. 3*c*), and two angled side faces 63, 63' (see FIG. 3*d*), respectively providing caming surfaces in both the indicated x and y axes.

Referring now to the second connecting part 6 as best illustrated in FIGS. 4–7, it should be seen that the second connecting part includes the plurality of projections 5 and as illustrated, each is mounted respectively to one of the upper and lower walls 24 and 26. The plurality of the projections 5 is defined by two projections 60, 62 which are in line with each other.

A third projection 64, is disposed adjacent the leading edge 70 of the second connector part 6. This projection is a locating and operates in conjunction with the detent 50 in the first housing part 4 and with a snap means 80 disposed proximate the leading edge 70 of the second connector part 6 to effect a single hand locking step connection for the connector. The locking means 80 includes a deflectable upwardly extending projection 82 which snap fits behind a correspondingly ledge 84 (see FIG. 1) and is so designed as to locate the second connecting part partially within the first connecting part 4.

In so positioning the projection 82 within the first housing part 6, the locating projection 64 is caused to be pushed up against the detent 50 and deflect it upwardly via the caming surface 61 and displace it out of the path of the cam slide 2, thereby allowing the cam slide to be fully inserted within the first housing part 6. Likewise, the spacing between the locating projection 64 and the two in line projections 60,64 is such that the in line projections 60,64 are simultaneously positioned through the interruptions 16,16 in the side edge 14 of the cam slide 2 and are located within the camming slots 15,15. Thereafter, with the first and second connector parts being maintained in a partially connected condition by virtue of the locking means 80 maintaining the first and second connector parts in relative alignment with one another in this manner, the user need only compress the cam slide between the index and the thumb finger to effect the drawing in of the second connecting part into the first connecting part in the manner which is known in the industry to effect connection between the electrical terminals 100 which are hereafter automatically aligned and electrically connected by virtue of the lateral sliding action of the cam 2.

As seen in FIG. 1, one of the caming slots 12 has a receiving notch 90 formed in it. The notch 90 is correspondingly sized and shaped to receive the inwardly directed projection of the detent 50 once the second connector part is driven forwardly into final position to thereby lock the first and second housing parts in place.

The cam slide 2 also comprises recesses 92 behind the leading edges 53 and notches 90. The recesses 92 receive the third projections 64 such that the third projections 64 do not block movement of the cam slice 2 as the slide 2 is being pushed into the first connector part 4 from the position shown in FIG. 3*a*.

Accordingly, the invention has been described by way of illustration rather than limitation. However, numerous modifications and substitutions may be had without departing from the spirit of the invention. For example, the cam slide is shown with a generally U-shaped configuration, but it is well within the purview of the invention to provide a cam slide which is of an L-shaped configuration with only one planar slide member to effect the functionings of the present invention.

What is claimed is:

1. An electrical connector assembly comprising:

a first electrical connector comprising a first housing, first electrical contacts connected to the first housing, and a cam slide movably connected to the first housing;

a second electrical connector comprising a second housing and second electrical contacts connected to the second housing, wherein the second housing comprises at least two cam projections on a first side thereof located a substantially equal distance from a front end of the second housing, wherein the cam slide comprises at least two cam slots having a substantially same shape camming surface equally spaced from a side edge of the cam slide, wherein the first housing comprises a deflectable detent to prevent the cam slide from being moved to a full engagement position on the first housing until the second housing is at least partially inserted into the first housing, and wherein the second housing comprises a detent moving projection, located closer to the front end of the second housing than the cam projections, which is adapted to move the detent out of a blocking position.

2. An assembly as in claim 1 wherein the first housing further comprises a longitudinal slot and the cam slide comprises a deflectable arm with a portion slidingly located in the longitudinal slot.

3. An assembly as in claim 1 wherein the cam slide comprises a receiving notch contiguous with one of the cam slots for receiving a portion of the detent when the cam slide is moved to the full engagement position on the first housing.

4. An assembly as in claim 1 wherein the first and second housings comprise a partial connection snap latch and ledge to retain the first and second housings in a partially connected position relative to each other, the partially connected position comprising the detent moving projection displacing the detent out of the blocking position.

5. An assembly as in claim 1 wherein the cam slide comprises a recess to receive the detent moving projection.

6. An electrical connector assembly comprising:

a first electrical connector comprising a first housing, first electrical contacts connected to the first housing, and a cam slide movably connected to the first housing;

a second electrical connector comprising a second housing and second electrical contacts connected to the second housing, wherein the second housing comprises at least one cam projection on a first side thereof and at least one detent moving projection, and a partial connection snap latch, wherein the first housing comprises a deflectable detent to prevent the cam slide from being moved to a full engagement position on the first housing until the second housing is at least partially inserted into the first housing, and wherein the first housing comprises a partial connection ledge, the partial connection snap latch and ledge retaining the first and second housing in a partially connected position relative to each other, the partially connected position comprising the detent moving projection displacing the detent out of a blocking position that blocks movement of the cam slide.

* * * * *